US005240440A

United States Patent [19]

Le Bris

[11] Patent Number: 5,240,440

[45] Date of Patent: Aug. 31, 1993

[54] ELECTRICAL CONNECTOR LOCKING RING

[75] Inventor: Henri Le Bris, Antony, France

[73] Assignee: Souriau et Cie., Versailles, France

[21] Appl. No.: 946,669

[22] Filed: Sep. 18, 1992

[30] Foreign Application Priority Data

Sep. 19, 1991 [FR] France ..... 91 11560

[51] Int. Cl.[5] ..... H01R 13/436

[52] U.S. Cl. ..... 439/752; 439/598

[58] Field of Search ..... 439/752, 686, 695, 598, 439/599, 603, 690, 701

[56] References Cited

U.S. PATENT DOCUMENTS

| | | | |
|---|---|---|---|
| 3,631,375 | 12/1971 | Briddle | 439/595 |
| 4,072,383 | 2/1978 | Cameron et al. | 439/598 |
| 4,758,182 | 7/1988 | Anbo et al. | 439/592 |
| 4,820,204 | 4/1989 | Batty | 439/695 |
| 4,944,688 | 7/1990 | Lundergan | 439/752 |
| 4,973,268 | 11/1990 | Smith et al. | 439/598 |

FOREIGN PATENT DOCUMENTS 2265193 10/1975 France .

*Primary Examiner*—Gary F. Paumen

*Attorney, Agent, or Firm*—Pollock, Vande Sande & Priddy

[57] ABSTRACT

An electrical connector comprises a front insulating body formed with a plurality of parallel passages formed with respective abutment shoulders and having a rear tubular skirt; a plurality of electrical contacts each in a passage and in abutment against the shoulder thereof and an electrically insulating plate insertable into and within the skirt. The plate has catch fingers arranged for abutment against a rearwardly directed shoulder formed on each contact for locking the contact. The plate can be locked in abutment against the front insulating body. The passages in the front insulating body have such a shape that they prevent the catch fingers from spreading apart and that they maintain the catch fingers against the shoulders of the contacts when the plate is in abutment against the insulating plate. An intermediate adapter has a tubular section which is insertable from the rear onto the skirt of the front insulating body and has forwardly projecting resilient fastening fingers arranged for snapping into recesses of the front insulating body when the intermediate adapter is forced into complete insertion.

8 Claims, 2 Drawing Sheets

ELECTRICAL CONNECTOR LOCKING RING

BACKGROUND OF THE INVENTION

This invention concerns electrical connectors comprising a plurality of contact components and is designed to be coupled with a complementary connector. More particularly, it concerns electrical connectors of the type comprising a front insulating body formed with a plurality of parallel passages each having a respective abutment shoulder, the front insulating body having a rearwardly extending tubular skirt; a plurality of electrical contacts each in a respective one of the passages and each in abutment against the shoulder thereof; and an electrically insulating plate insertable into and within the skirt for abutment, against a surface of the front insulating body, the plate having a plurality of catch fingers arranged for abutment against respective rearwardly directed shoulders formed on the contacts, for locking the contacts.

SUMMARY OF THE INVENTION

It is an object of the invention to provide a connector that is easy to dismantle and assemble, but is nevertheless of simple construction.

To this end, there is provided a connector having means for maintaining the plate in abutment against the front insulating body.

The passages in the front insulating body have a shape such that they prevent the catch fingers, from spreading apart and that they mantain the catch fingers against the shoulders of the contacts when said plate is in abutment against the surface of the insulating body.

The connector preferably further comprises an intermediate adapter having a tubular section which is insertable from the rear onto the tubular skirt of the front insulating body, the intermediate adapter having forwardly projecting resilient fastening fingers arranged for snapping into recesses of the front insulating body when the intermediate adapter is forced into a complete insertion position.

This arrangement makes it possible to withdraw all the contacts without separation of the plate.

BRIEF DESCRIPTION OF THE DRAWINGS

The invention will be better understood on reading the following description of an embodiment thereof given by way of example.

DETAILED DESCRIPTION OF PREFERRED EMBODIMENT

Figure 1:
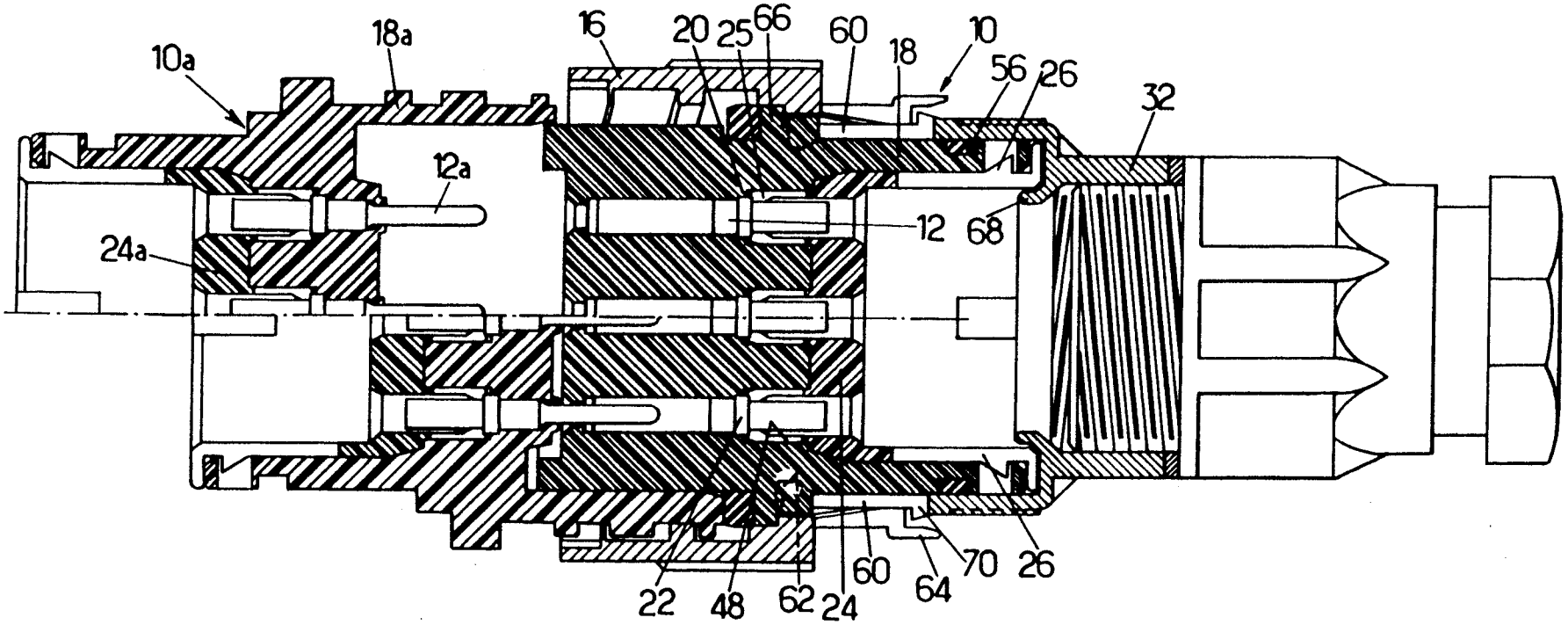
FIG. 1 shows schematically, in cross-section along a plane passing through the axis, two connectors designed to cooperate, one half of one of the connectors being shown in coupling position, and the other half in uncoupled position.
Figure 3:
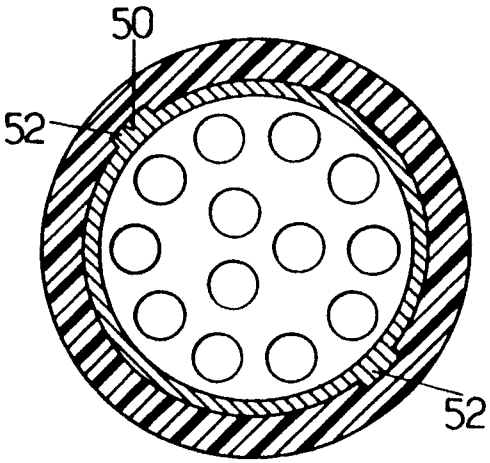
FIG. 3 is a cross-sectional view along line III—III of FIG. 2.
Figure 2:
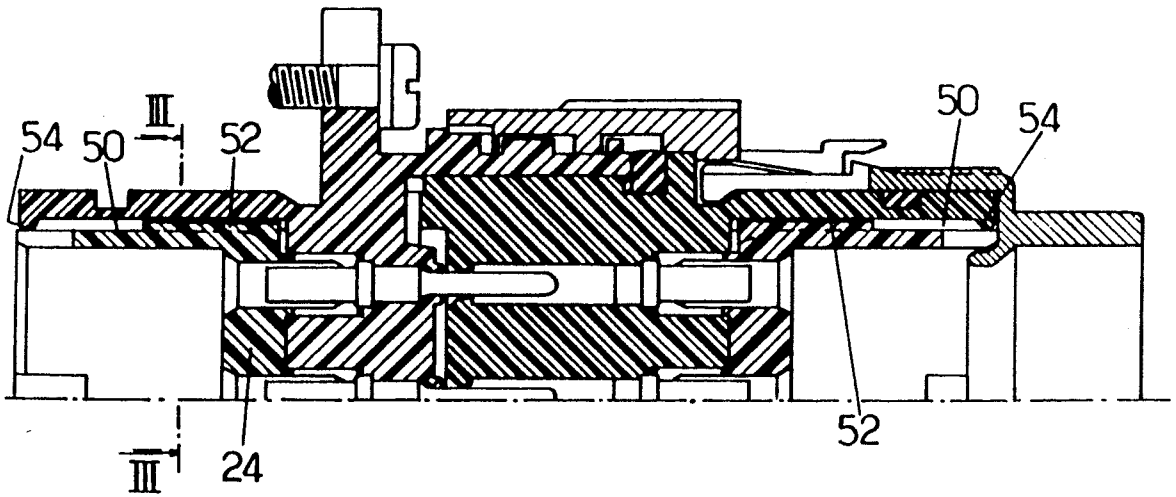
FIG. 2 shows the double locking of the connectors of FIG. 1, in cross-section along a plane passing through the axis, different from that of FIG. 1.

The mutually mating connectors shown in FIGS. 1 to 3 can be used in particular for automobile manufacture, in which double locking safety is recommended. One of them is a plug 10 and the second a receptacle 10*a*. Each has several contact components, which are shown as jacks 12 on the connector forming the plug, pins 12*a* on the connector forming the receptacle.

Plug 10 comprises a front insulating body 18 formed with parallel passages for receiving contacts 12. Each passage exhibits a shoulder 20 directed backward, for acting as a stop for a corresponding flange 22 provided on the contact and hence for fixing the position of this contact. The rear part of the insulating body constitutes a tubular skirt designed to receive a plate 24 for retaining the contacts. The plate has a set of flexible catch fingers 25 directed forwardly associated with each passage. In the embodiment shown, the fingers 25 have a shape at rest such that they define a passage smaller than the cross-section of the flange 22 of the contacts, designed to bear against shoulder 20. They must therefore be spread apart to allow insertion or extraction of the contacts. This spreading is prevented, when the plug is assembled, by the wall of a recess 48 formed in the front insulating body 18. In an advantageous embodiment, the fingers have a terminal bulge for sliding on the shank of the contact components and for undergoing no deformation and no permanent bending stress.

In the embodiment shown as an example, the means of fixing the plate 24 to the insulating body 18 comprise lugs 26 directed backward, two in number for example, terminating in fork-shaped hooks, which are inserted in terminal circumferential slots of the skirt of the front insulating body. The lugs 26 keep the contacts 12, the plate 24 and the front insulating body 18 in assembled condition while allowing disassembly.

It is often necessary for the plate 24 to be inserted into the insulating body 18 only in a single angular position. To this end, indexing means can be provided. FIGS. 2 and 3 show means for indexing each connector constituted by longitudinal grooves 50 in the front insulating body and keys 52 of matching shape formed on the plate.

To prevent total separation of the plate when the lugs 26 are released, flanges 54 can be provided at the ends of the grooves 50. Backward movement of the plate is accordingly limited by abutment of the back edge of the keys 52. The resiliency of the parts nevertheless makes it possible to separate them as when required.

An intermediate adapter 32, which may be made of several assembled parts, is removably secured to the insulating body and represents a transition with the cable adapter. It can also supplement the retention of the plate. It has a front part portion designed to slide on a back section of the front insulating body 18, and a rear portion which bears against the terminal fork of the lugs 22. An O-ring 56 can be provided between the intermediate adapter 32 and the insulating body 18 to act as a seal.

The means for securing the intermediate adapter comprise resilient fastening fingers 60 extending the adapter 32 forwardly, which latch into circumferential recesses of the insulating body 18, behind a ring 66. Bosses can be provided in the recesses 62 to allow the assembly of the intermediate adapter 32 in a single angular direction only, if required. The bosses thus also prevent rotation of the intermediate adapter. These bosses can be designed each to be inserted between two resilient fingers 60.

Connectors 10 and 10*a* are fitted with complementary fastening means. In the case of the plug 10, these means comprise a locking ring 16 designed to be screwed on an external thread of the front insulating body 18 of the receptacle 10*a*. The locking ring 16 may have front locking holes cooperating with studs provided on the insulating body 18*a*, in accordance with the arrangement described in document FR-A-2 632 783.

In the embodiment shown as an example, the locking ring 16 extends backward as resilient lugs 64 which may perform several functions, particularly that of a retaining the ring longitudinally on the intermediate adapter 32 in the case shown, directly on the insulating body in other cases. These lugs 64 have a step directed backward which, when the ring is in place, lies opposite a circumferential latching notch 70 provided on the intermediate adapter 32. Backward movement of the ring is thus prevented. At the front, when in place, the ring bears against the flange 66 which enables it to rotate.

The connector 10 described here can be assembled as follows.

The locking ring 16 is slid on the cable (not shown) which may already be provided with its terminal contacts. The intermediate adapter 32 is positioned on the cable. The plate is inserted into the front insulating body, but left in the rearmost position defined by bearing against the flanges 54. The contacts can then be mounted through the plate 24, from the rear. They latch in when snapping beyond the resilient catch fingers 25. Once the contacts are in place, the plate 24 is pushed forward until the resilient locking lugs 26 are hooked in the slots at the back of the insulating body.

Once the plate has latched into the body, the intermediate adapter 32 is inserted on the insulating body, by simply pressing. The lugs 60 spread apart until they reach the recesses.

The locking ring 16 can then be advanced until it bears against the flange 66, in front of the recesses 62. At this time, the resilient lugs 64 have come beyond the notch 70.

Disassembly is carried out in the reverse order of operations.

To disassemble the locking ring 16, the resilient lugs 64 are spread with a tool and the ring 16 is pulled backward. The intermediate adapter 32 must first be released from the means which retain it, e.g., a threaded transition sleeve, screwed on the threaded rear section of the intermediate adapter 32. The intermediate adapter 32 can then be pulled backward to release its resilient lugs 60.

It is then possible to dismantle the contacts. The resilient lugs 26 are pinched to release them from the hooking slots, for example using a screwdriver, and the plate is then pulled backward until it abuts the flange 54. Each contact can then be removed by pulling on its cable: the resilient fingers 25 open under pressure.

The intermediate adapter can be supplemented by an internal support neck 68 on a grommet (not shown) inserted between it and the plate 24. This neck can also, or exclusively, be provided to prevent detachment of the lugs 26.

The receptacle 10*a* constituting the complementary connector may have a similar construction to that of the plug 10. FIG. 3 shows the indexing keys of the plate 24*a* in the insulating body 10*a* which also constitutes the casing formed with the threads for receiving the ring 16. It can be seen that the keys have two different widths to ensure angular polarization.

The parts other than the insulating bodies and the retaining parts can be made of any suitable material, and specially of reinforced plastic.

I claim:

1. An electrical connector matable with a complementary connector, comprising:

a front insulating body formed with a plurality of parallel passages each having a respective abutment shoulder, said front insulating body having a rearwardly extending tubular skirt;

a plurality of electrical contacts each in a respective one of said passages and each in abutment against the shoulder thereof;

an electrically insulating plate insertable into and within said skirt for abutment against a surface of said front insulating body, said plate having a plurality of catch fingers arranged for abutment against respective rearwardly directed shoulders formed on said contacts, for locking said contacts;

and means for maintaining said plate in abutment against said front insulating body;

wherein said passages in the front insulating body have such a shape that they prevent said catch fingers from spreading apart and that they maintain said catch fingers against said shoulders of said contacts when said plate is in abutment against said surface of said insulating body, and wherein said connector further comprises an intermediate adapter having a tubular section which is insertable from the rear onto said tubular skirt of said front insulating body, said intermediate adapter having forwardly projecting resilient fastening fingers arranged for snapping into recesses of said front insulating body when said intermediate adapter is forced into a complete insertion position.

2. Connector according to claim 1, wherein said means maintaining said plate in abutment comprise a plurality of rearwardly projecting resilient lugs of said plate constructed for snapping engagement onto said tubular skirt of the front insulating body.

3. Connector according to claim 2, wherein said lugs have terminal fork-shaped hooks for engagement into circumferential slots of said skirt and wherein said intermediary adapter has a radially inner neck preventing unlocking of said lugs when said intermediate adapter is locked on the front insulating body.

4. Connector according to claim wherein said recesses are separated by bosses shaped to authorize insertion of said intermediate adapter only in a predetermined angular position.

5. Connector according to claim 1, further comprising means for retaining the plate connected to said front insulating body while permitting sufficient rearward movement of said plate to clear said catch fingers.

6. Connector according to claim 5, wherein said means comprises flanges closing rear portions of respective indexing grooves formed in said skirt and keys of said plate slidably received in said indexing grooves.

7. Connector according to claim 1, further comprising an internally threaded locking ring retained against forward movement with respect to said front insulating body by a flange of said front insulating body, having a plurality of rearwardly directed resilient lugs each having a terminal shoulder located for being received behind a circumferential latching notch formed on said front insulating body or on said intermediate adapter.

8. Connector according to claim 7, wherein said locking ring is located around said fastening fingers of said intermediate adapter for maintaining them in respective ones of said recesses.

* * * * *